US005700134A

United States Patent [19]

Huntley

[11] Patent Number: 5,700,134

[45] Date of Patent: Dec. 23, 1997

[54] DIFFUSION PUMPS

[75] Inventor: Graeme Huntley, Crawley, England

[73] Assignee: The BOC Group plc, Windlesham, England

[21] Appl. No.: 609,805

[22] Filed: Mar. 1, 1996

[30] Foreign Application Priority Data

Mar. 3, 1995 [GB] United Kingdom ..... 9504260

[51] Int. Cl.[6] ..... F04F 9/00

[52] U.S. Cl. ..... 417/153

[58] Field of Search ..... 417/152, 153, 417/154

[56] References Cited

U.S. PATENT DOCUMENTS

| | | | |
|---|---|---|---|
| 2,078,788 | 4/1937 | Bancroft | 417/154 |
| 2,855,140 | 10/1958 | Sedlacsik, Jr. | 417/154 |
| 3,785,162 | 1/1974 | Long et al. | 417/152 |
| 3,801,225 | 4/1974 | Power | 417/153 |
| 4,108,576 | 8/1978 | Landfors | 417/153 |
| 4,845,360 | 7/1989 | Landfors | 417/154 |
| 5,137,429 | 8/1992 | Broadhurst | 417/152 |

FOREIGN PATENT DOCUMENTS

| | | | |
|---|---|---|---|
| 526507 | 9/1940 | United Kingdom | 417/153 |

*Primary Examiner*—Timothy Thorpe
*Assistant Examiner*—Peter G. Korytnyk
*Attorney, Agent, or Firm*—David M. Rosenblum; Salvatore P. Pace

[57] ABSTRACT

A diffusion pump is provided with an outer body and a chimney positioned within the outer body. A top cap is positioned about the top of the chimney to form an annular passageway (or an annular array of passageways) therebetween. A guard ring is positioned generally above the top cap. Coolers cool the outer body and the guard ring and working fluid present in the base of the outer body is heated to cause evaporated oil to pass up the chimney. A baffle, substantially thermally isolated from the guard ring, is contained within the outer body.

7 Claims, 1 Drawing Sheet

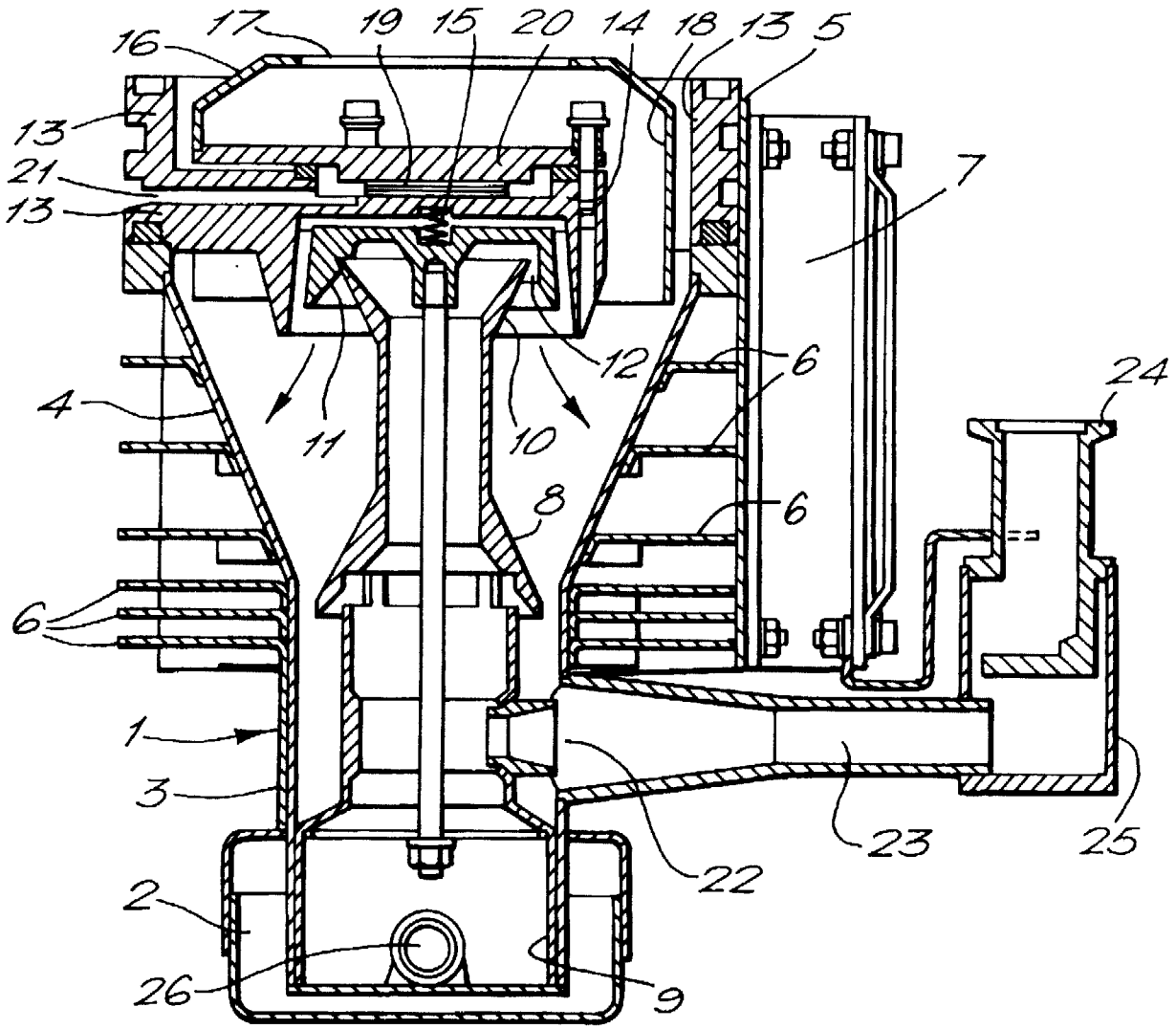
24
25
7
23
5
13
18
6
6
22
14
12
9
20
10
8
15
19
11
17
16
13
21
13
4
6
1
3
2
26

DIFFUSION PUMPS

BACKGROUND OF THE INVENTION

This invention relates to vacuum pumps of the type known as diffusion pumps.

Diffusion pumps are well known and widely used for the attainment of high and ultra high vacuum. When used with modern working fluids and accessories, they can produce pressures approaching $10^{-10}$ mbar. The pumps are generally incapable of exhausting directly to the atmosphere and require the use of a backing pump, commonly an oil sealed rotary vacuum pump, in conjunction with the diffusion pump itself.

Diffusion pumps generally comprise a substantially cylindrical outer body which is cooled by, for example, coils helically wound around the outside of the body through which cooling water can be circulated or alternatively by air cooled fins attached to the outside of the body.

Within the outer body is positioned a hollow "chimney" sitting at, or close to, the base of the outer body and which tapers (continuously or, more usually, in stages) upwardly from the base. The chimney is generally contained within the outer body and is positioned substantially concentrically therein.

Across the top of the chimney but not in contact therewith is a top cap having a generally circular portion of somewhat larger diameter than the top of the chimney and positioned symmetrically with regard to the chimney and having a downwardly projecting annular side portion whose lower edge is somewhat beneath the upper edge of the chimney. The top cap is therefore substantially an inverted "cup shaped" component positioned about the top of the chimney with a circular or annular passageway therebetween.

A heater is provided in the base of outer body and, prior to use of the pump, a working oil is placed in the base of the body to a height above the lower edge of the chimney positioned wig the body. The oil is usually a low vapour pressure oil although some versions of diffusion pumps use mercury.

A pump inlet is positioned in the outer body above the top cap and an outlet in the side of the body towards the base of the chimney but above the oil level. The outlet is normally connected to a backing pump as described above.

In use of pumps of this type, the inlet of the pump is normally closed by a valve initially and the backing (rotary) pump is turned on and left running continuously, a pressure of at least 0.1 mbar being required on the exhaust side of the diffusion pump. The cooling system (water or air) for the outer body is turned on and the oil can now be heated by the heater for, for example, fifteen to twenty minutes, when it begins to boil. Hot vapour rises up the chimney and forms (aided by the taper) a relatively high oil pressure at the top of the chimney. The vapour is then urged through the passageway between the chimney and the top cap to an area of much lower pressure and creates an annular vapour jet (or "jet nozzle"). This yet is designed to move at a velocity which is supersonic and which impinges on the inside surface of the cooled outer body where the vapour condenses and condensed oil flows down the inside wall of the outer body and returns to the oil reservoir at the base of the body.

With the diffusion pump turned on, gas molecules being pumped in to the inlet of the diffusion pump are likely to collide with the much heavier oil vapour molecules and be provided with a velocity component which will direct the gas molecules towards the outlet of the diffusion pump where they will be subsequently removed from the diffusion pump via the backing pump. A pressure difference is thereby established across the continuously flowing vapour jet.

It is important that suitable valving and operation cycles be employed to ensure that the diffusion pump itself is not exposed to the atmosphere whilst the oil is at working temperature in view of problems which can arise from oil degradation and pumping system contamination.

In a vacuum system employing such pumps, the pressure will eventually reach an equilibrium at which continued operation of the pump will not thereafter further reduce the pressure of the system. This is due at least in part by the pressure of working oil vapour present in the system which can be caused by one or both of:

i) "back streaming" being the direct flow of oil molecules from the jet nozzle towards the inlet to the pump, and ii) "back migration" being the transfer of vapour to the high vacuum side by re-evaporation of oil molecules which have condensed on surfaces within the pump.

Although the latter is temperature dependent and can therefore often be cured by cooling the relevant surfaces further, the former is more difficult to suppress.

Back streaming however can, usually be significantly reduced through the use of a "guard ring" (or "cold cap"). In its simplest form, such a guard ring may comprise a cooled surface positioned above the top and in substantially thermal isolation therefrom. Preferably, it could have the same overall shape, for example substantially "cup-shaped", but of larger size in order to shroud the top cap.

Alternatively, the guard ring may be more complicated and present more cooled surfaces to any oil molecules attempting to escape towards the diffusion pump inlet.

Furthermore, it is relatively common practice additionally to employ a baffle which comprises a number of cooled surfaces to condense back streaming vapour molecules. Such a baffle is commonly present in a self contained component which can be positioned between a diffusion pump inlet flange and the chamber being evacuated.

However, baffles tend to detract from the ability to minimise the size, height and/or general complexity of a diffusion pump as a whole.

SUMMARY OF THE INVENTION

In accordance with the invention, there is provided a diffusion pump comprising an outer body means to cool the outer body chimney means positioned within the outer body a top cap positioned about the top of the chimney means to form an annular passageway (or an annular array of passageways) therebetween a guard ring positioned generally above the top cap means to cool the guard ring heater means to heat working fluid present in the base of the outer body and cause, in use, evaporated oil to pass up the chimney wherein the pump also comprises baffle means which are thermally substantially isolated from the guard ring and which are contained substantially wholly within the outer body.

As such the whole arrangement, including the baffle means are contained integrally within the outer body.

Preferably, the outer body and the guard ring are cooled by the same means, for example a fan. Use of such a fan can be aided by having cooling fins on the outer surface of the outer body and/or on the guard ring.

It is preferable for the baffle means to be at a colder temperature than that of the guard ring. Advantageously, the baffle means is cooled by means of a "Peltier" device. Such a device works on the principle that if a current is passed through a junction between two dissimilar conductors it will either cool or heat the junction depending on the direction of the current, the rate at which heat is generated being proportional to the magnitude of the current and the temperature junction. A Peltier device generally comprises many such functions connected thermally in parallel and electrically in series. Typically, 'p' and 'n' doped semiconductors soldered to copper connecting strips are used to form the junction. Ceramic face plates electrically insulate these connecting strips from external surfaces. The semiconductor material can be bismuth telluride which shows a very pronounced effect a moderate operating temperatures.

In preferred embodiments, a Peltier device is connected between the guard ring and the baffle means with the 'cold' end of the device in good thermal contact with the baffle means and the 'warm' end of the device in contact with the guard ring.

As such, the Peltier device represents the cooling means for the baffle means and heat transferred to the guard ring by the Peltier device can be removed by the cooling means, for example a fan, for the guard ring.

In further preferred embodiments, the baffle means is present directly in the diffusion pump inlet, ideally within the guard ring itself. Such feature of the invention allow for a more compact design of diffusion pump that can be more compact, shorter and be one which can be contained within a sigh body without any protrusions therefrom.

BRIEF DESCRIPTION OF THE DRAWINGS

For a better understanding of the invention, reference will now be made, by way of exemplification only, to the accompanying drawing showing a cross sectional view through a diffusion pump of the invention.

DETAILED DESCRIPTION

With reference to the drawing, there is shown a diffusion pump comprising an outer body 1 having a base portion 2, a central portion 3, a frusto conical portion 4, and a top portion 5 all of circular cross section. The top portion 5 in particular can generally be regarded as the pump inlet to which (by means not shown) a chamber to be evacuated is attached.

The portion 4 and the upper part of the portion 3 have annular cooling fins 6 attached to the outside surface thereof and on one side of the outer body is a cooling fan 7 for producing in use of supply of cooling air to the fins 6 in particular.

A chimney 8 is positioned within the outer body 1 having a base portion 9 of circular cross section such that it fits tightly within the base portion 2 of the body 1. The chimney 8 also has upper portions of different cross sections but generally presenting a tapered component narrowing towards the top. At the top, however, a small flared portion 10 which communicates the inside of the chimney with the inside of the body portion.

A top cap 11 is positioned about the flared portion 10 of the chimney being generally of circular "cup shape" and defining an annular array of passageways 12 between it and the flared portion 10.

Present within the top portion 5 of the outer body 1 is a generally circular guard ring 13 which is attached to the top portion 5 and which has a central portion 14 which extends across and above the top cap 11. The top cap 11 is in fact held in position by means of a spring 15 between the portion 14 and the top cap 11.

The guard ring as a whole, by virtue of its contact with the cooled outer body 1 in particular, is cooled by means of the cooling fins/fan arrangement for cooling the body as a whole. The top cap 11 itself, however, is not cooled as little heat is conducted via the spring 15.

In accordance with the invention, a baffle means 16 is provided which is generally within the top portion 5 and shaped such that it presents a surface at the inlet to the pump with a circular hole 17 through which gas being pumped can pass.

The baffle means also has an annular downwardly extending portion 18 contained concentrically within the guard ring 13 such that an annular passageway is formed within the portion 18 for gas passing in to the pump via the hole 17.

A Peltier device 19 connects the upper surface of the central portion 14 the guard ring 13 and the lower surface of a central portion 20 of the guard ring; this is the only thermally conducting connection between the guard ring and the baffle means.

The Peltier device is orientated such that its cold face abuts the baffle means and its warm face about the guard ring. Electrical connection to the Peltier device is effected via the channel 21.

The pump also possesses an outlet 22 which leads via a pipe 23 to a flange 24 to which is used is attached a backing pump, normally an oil sealed rotary pump of known construction. Beneath the flange 24 is a backing condenser 25 also of known construction and of no relevance to the invention.

A heater 26 is positioned at the base of the chimney.

In use of the pump, the backing pump is turned on to reduce the pressure within the diffusion pump, normally with the inlet of the diffusion pump closed, and the cooling fan turned on.

Heating of the oil causes oil vapour to rise up the chimney in the general manner described above and to emerge through the annular array of passageways 12 and thereafter to fall downwardly in the general direction shown by the arrows in to the cooled inner surface of the portion 4 in particular. During this time the top cap 11 is hot by virtue of the impingement thereof of the hot oil vapour but the guard ring 13 surfaces generally and its central portion 14 in particular are cool and assist in condensing any oil vapour which impinges thereon.

In the event of any backstreaming, the presence of, and the positioning of, the baffle means within the upper part of the guard ring 13 should ensure that any backstreaming oil vapour is effectively condensed and allow to fall into the base of the outer body/chimney (connection for the oil therebetween not shown) for re-use in the continuing pump operation.

I claim:

1. A diffusion pump comprising:

an outer body;

means for cooling the outer body;

chimney means positioned within the outer body;

a top cap positioned about the top of the chimney means to form at least one annular passageway therebetween;

a guard ring positioned generally above the top cap;

means for cooling the guard ring;

heater means for heating working fluid present in the base of the outer body, thereby causing evaporated oil to pass up the chimney; and baffle means, substantially thermally isolated from the guard ring and contained within the outer body.

2. The pump according to claim 1 in which the baffle means is located in an inlet of the diffusion pump.

3. The pump according to claim 2 in which the baffle means is located within the guard ring.

4. A diffusion pump comprising:

an outer body;

chimney means positioned within the outer body;

a top cap positioned about the top of the chimney means to form at least one annular passageway therebetween;

a guard ring positioned generally above the top cap;

means for cooling the outer body and the guard ring;

heater means for heating working fluid present in the base of the outer body, thereby causing evaporated oil to pass up the chimney; and baffle means, substantially thermally isolated from the guard ring and contained within the outer body.

5. The pump according to claim 1 or claim 2 in which the baffle means are at a colder temperature than that of the guard ring.

6. The pump according to claim 1 or claim 4 comprising a Peltier device to cool the baffle means.

7. The pump according to claim 6 in which the Peltier device is connected between the guard ring and the baffle means with a cold end of the Peltier device in thermal contact with the baffle means and a warm end of the Peltier device in contact with the guard ring.

* * * * *